United States Patent [19]

Sonesson

[11] Patent Number: 4,927,401

[45] Date of Patent: May 22, 1990

[54] RADIO CONTROLLABLE SPHERICAL TOY

[76] Inventor: Harald V. Sonesson, Stenåldersvägen 131, S-222 54 Lund, Sweden

[21] Appl. No.: 390,773

[22] Filed: Aug. 8, 1989

[51] Int. Cl.[5] ..... A63H 30/04; A63H 17/00; A63H 17/14; A63G 25/00

[52] U.S. Cl. ..... 446/456; 446/437; 446/433; 280/206

[58] Field of Search ..... 446/437, 438, 439, 433, 446/431, 456, 454, 457, 458, 462; 180/79.3; 280/206, 827, 1.22, 221, 226

[56] References Cited

U.S. PATENT DOCUMENTS

| | | | |
|---|---|---|---|
| 2,832,426 | 4/1958 | Seargeant | 446/433 X |
| 3,500,579 | 3/1970 | Bryer | 446/437 X |
| 3,722,134 | 3/1973 | Merrill et al. | 446/462 |
| 3,746,117 | 7/1973 | Alred | 280/206 X |
| 4,438,588 | 3/1984 | Martin | 446/438 X |
| 4,471,567 | 9/1984 | Martin | 446/437 |
| 4,541,814 | 9/1985 | Martin | 446/456 |
| 4,726,800 | 2/1988 | Kobayashi | 446/458 |

FOREIGN PATENT DOCUMENTS

| | | | |
|---|---|---|---|
| 909554 | 4/1954 | Fed. Rep. of Germany | 446/433 |
| 2505074 | 2/1976 | Fed. Rep. of Germany . | |
| 206715 | 8/1971 | France . | |
| 2539904 | 7/1984 | France | 446/454 |
| 1292441 | 10/1972 | United Kingdom | 446/458 |

*Primary Examiner*—Robert A. Hafer
*Assistant Examiner*—D. Neal Muir
*Attorney, Agent, or Firm*—Laurence R. Brown; Alfred J. Mangels

[57] ABSTRACT

A radio-controlled spherical toy is designed as a hollow, preferably transparent sphere containing a radio-controlled vehicle supported on two drive bands having a track contact between points the maximum distance between which is less than 80% of the inner diameter of the sphere.

4 Claims, 2 Drawing Sheets

RADIO CONTROLLABLE SPHERICAL TOY

FIELD OF THE INVENTION

This invention relates to a radio-controlled spherical toy which may be moved in any desired direction by a radio-controller.

BACKGROUND OF THE INVENTION

Toys of the type referred to above have been designed either as a vehicle engaging frictionally the inside of a spherical shell by two wheels at a maximum distance—i.e. so that the points of contact will be located oppositely at a diameter of the shell—or they have been designed as a hollow shell containing a body which is movable relative a diametrically arranged shaft in the shell.

The U.S. Pat. No. 4,541,814 discloses a toy of the first mentioned type. It has a steering wheel mounted diametrically opposite a driving wheel making it difficult to perform distinct movements in any direction.

The U.S. Pat. No. 4,726,800 shows an example of the other of the said two types of known toys.

According to the '800 patent a shaft is rigidly mounted in a hollow shell and said shaft is carrying a chassi the gravity center of which is located at a distance from the shaft. A motor is used for causing relative movements between the chassi and the shaft.

This type of toy has also the drawback that distinct shifts of movements of the toy are difficult to obtain.

SUMMARY OF THE INVENTION

According to the present invention a radio-controllable substantially spherical toy comprising a hollow, substantially spherical toy body having an inner surface substantially concentric with the outer surface thereof and containing a radio-controlled vehicle having means frictionally engaging said inner surface for causing relative movements between said vehicle and said body is characterised in that said means consist of two endless bands each being wrapped around a system of support and and driving wheels and having such dimensions that the maximum distance between points of engagement between said bands and said body is less than 80% of the diameter of the inner surface of said body.

DETAILED DESCRIPTION OF THE EMBODIMENT SHOWN

Figure 1:
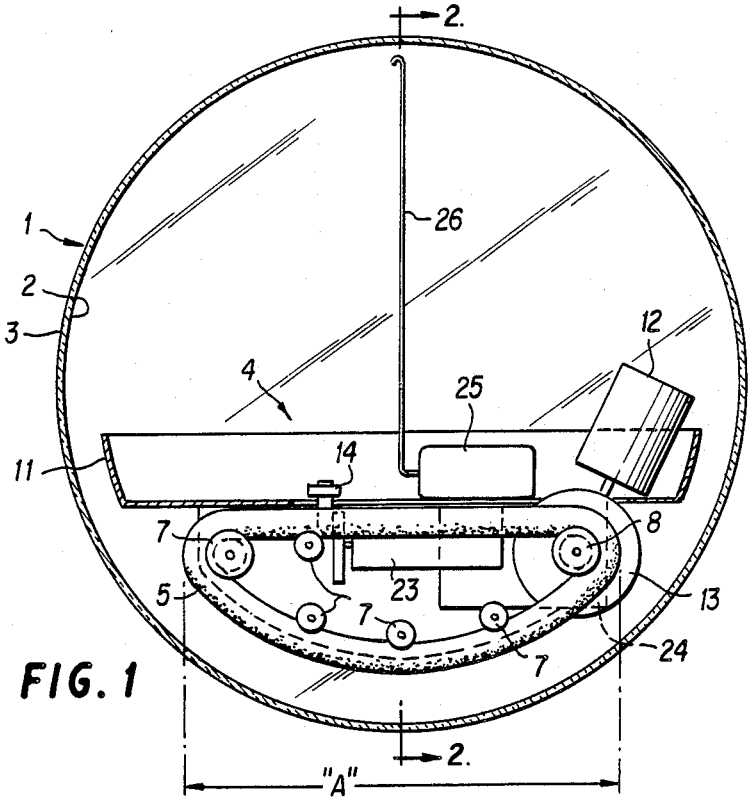
FIG. 1 shows schematically a vertical section through a toy according to the invention following the line I—I of FIG. 2.
Figure 2:
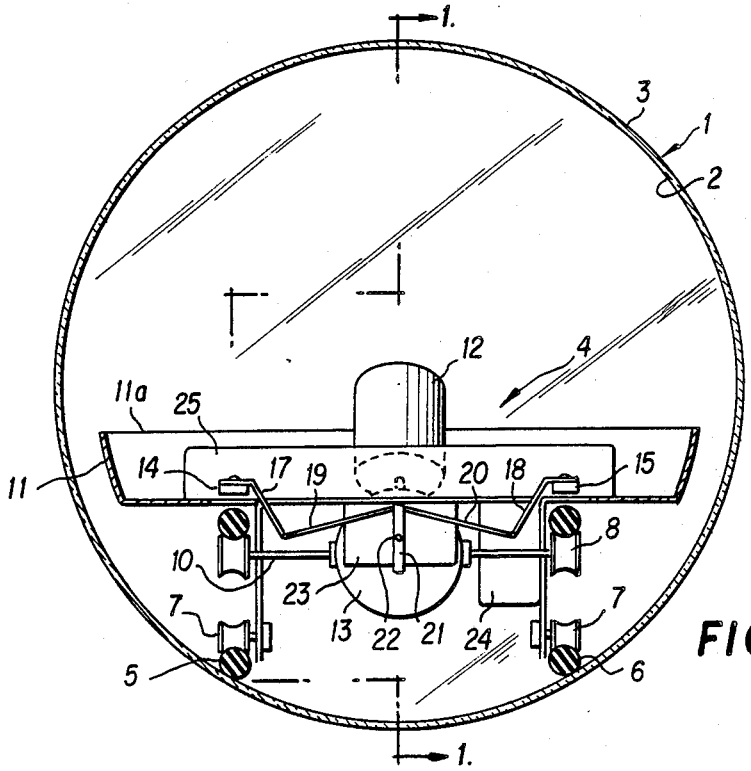
FIG. 2 is a vertical section through the toy of FIG. 1 along the line II—II of FIG. 1.
Figure 3:
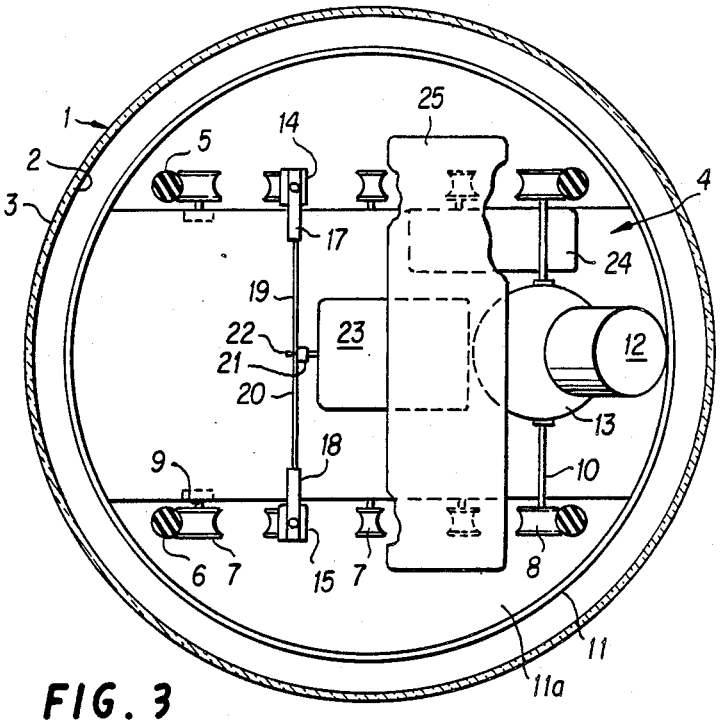
FIG. 3 is a view of the toy of FIGS. 1 and 2 seen from the above and FIG. 4 is a perspective view of the toy.
Figure 4:
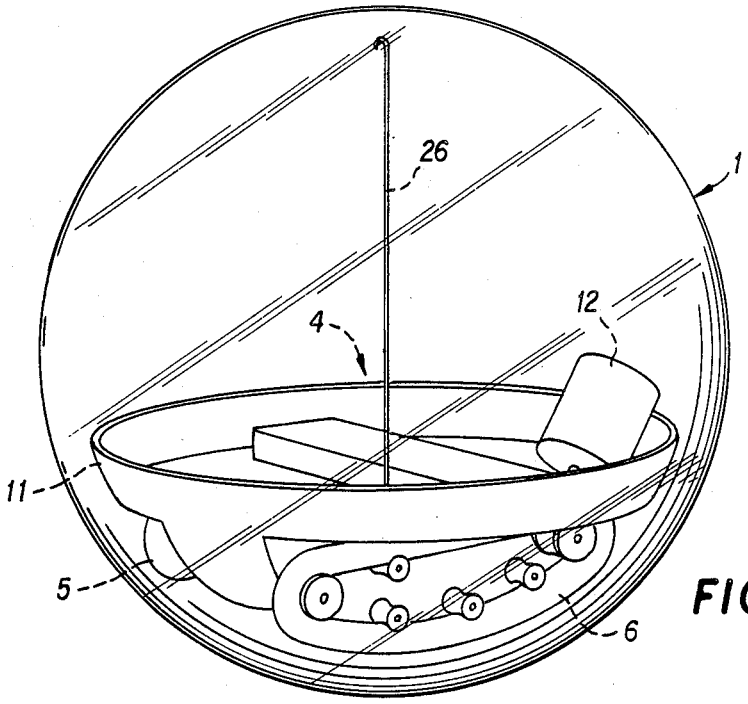

In the drawings the reference numeral 1 designates a spherical toy body made of a transparent plastic material. Said body 1 has an inner surface 2 concentric with the outer surface 3. A radio controlled vehicle generally designated by 4 comprises means 5, 6 for frictionally engaging the inner surface 2. The said means 5, 6 consists of two rubber bands 5, 6 wrapped around a system of support wheels 7 and a drive wheel 8 for each band 5 or 6.

The greatest distance "A" between points of contact between the means 5,6 and the inner surface 2 of the body 1 is substantially less than the diameter of the inner surface 2—i.e. at least less than 80% of said diameter.

The body 1 has thus been designed as a track vehicle and the support wheels 7 will guide the bands so that their parts adjacent to the inner surface 2 will have an almost corresponding curvature.

The wheels 7, 8 are mounted on shafts 9, 10 journalled in a chassi 11 having a platform **11*a* which could be used for advertising or decoration items (not shown). The chassi 11 carries a drive train including a motor 12 and a differential 13. The motor 12 is reversible and each rubber band 5, 6 may be individually braked by blocks 14, 15 mounted on levers 17 and 18 respectively. The levers 17, 18 are pivotally supported in the chassis 11 and may be activated by rods 19, 20. The height of the platform 11*a* is less than 50% of diameter of the inner surface 2 of the body 1**.

The blocks 14, 15 are mounted at locations of the bands 5, 6 close to support wheels 7.

The rods 19, 20 are pivottally connected to a key member 21 mounted on a key shaft 22 which may be turned in both directions from the neutral position shown by means of a servo-mecanism 23. A radio receiver unit 24 activates the motor 12 and the servo-mechanism 23 both powered by a battery 25. An antenna 26 is provided for receiving radio signals. All parts of the power train and the steering mechanism are conventionally available items and form no parts of the present invention.

The toy described will operate as follows:

The radio receiver unit 24 will receive and transmit signals to the motor 12 and to the brake servo mechanism 23. The motor 12 will start running in one or the other direction and cause a straight path of the chassi 11 relative the ground on which the body 1 will be caused to roll.

A turning of the key shaft 22 will cause braking of one of the bands 5 or 6 and cause a turning of the chassi 11 relative the ground on which the body 1 is rolling. This turning may be at a sharp 90° angle or it may be at any other greater or smaller angle in or without combination with a shift in driving direction. The rather large diameter of the body 1 relative the size of the vehicle 4 ensures an ability of the the body 1 to force substantial restrictions on the ground surface.

The low height of the vehicle 4 compared with the size of the body 1 leaves a substantial free space within the body 1. This could be used for decoration or advertising purposes.

I claim:

1. A radio-controllable substantially spherical toy comprising a hollow, substantially spherical toy body having an inner surface substantially concentric with an outer surface thereof and a predetermined diameter of the inner surface of said body containing a radio controlled vehicle having means frictionally engaging said inner surface for causing relative movements between said vehicle and said body, characterized in that said means consist of two endless bands each said band engaging the inner surface for traction and being wrapped around a system of a plurality of support wheels and at least one driving wheel defining an arced length, said endless bands having such dimensions that a maximum distance between end points of said arcedlength, of engagement between said bands with the inner surface of said body is less than 80% of the diameter of the inner surface of said body.

2. A toy according to claim 1 in which said bands are rubber bands.

3. A toy according to claim 1 in which said means are mounted on a chassi having a height which is less than 50% of the diameter of the inner surface of said body.

4. A toy according to claim 1 in which said bands along the system of support and guiding wheels thereof adjacent the inner surface of said body include means for guiding the bands to follow a substantially circular path corresponding to the inner surface of said body.

* * * * *